US009564087B2

(12) United States Patent
Maeda

(10) Patent No.: US 9,564,087 B2
(45) Date of Patent: Feb. 7, 2017

(54) ELECTROPHORETIC DISPLAY DEVICE, ELECTRONIC TIMEPIECE, AND OPERATING METHOD OF AN ELECTROPHORETIC DISPLAY DEVICE

(71) Applicant: Seiko Epson Corporation, Tokyo (JP)

(72) Inventor: Hiroshi Maeda, Haramura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/597,842

(22) Filed: Jan. 15, 2015

(65) Prior Publication Data

US 2015/0206479 A1 Jul. 23, 2015

(30) Foreign Application Priority Data

Jan. 20, 2014 (JP) ..... 2014-007863

(51) Int. Cl.
*G09G 3/34* (2006.01)

(52) U.S. Cl.
CPC ..... *G09G 3/344* (2013.01); *G09G 2300/0857* (2013.01); *G09G 2310/068* (2013.01); *G09G 2310/08* (2013.01); *G09G 2320/041* (2013.01); *G09G 2320/0666* (2013.01); *G09G 2330/021* (2013.01)

(58) Field of Classification Search
CPC ..... G09G 3/344; G09G 2320/041; G09G 2330/021; G09G 2300/0857; G09G 2310/08; G09G 2320/0666; G09G 2310/068
USPC ..... 345/107
See application file for complete search history.

(56) References Cited

U.S. PATENT DOCUMENTS

| | | | | |
|---|---|---|---|---|
| 8,237,653 | B2 | 8/2012 | Maeda et al. | |
| 2008/0088545 | A1* | 4/2008 | Chen | G09G 3/3225 345/76 |
| 2008/0150887 | A1 | 6/2008 | Kim et al. | |
| 2009/0109171 | A1* | 4/2009 | Akaiwa | G09G 3/344 345/107 |
| 2010/0207924 | A1* | 8/2010 | Saito | G09G 3/344 345/211 |
| 2010/0238158 | A1* | 9/2010 | Yoshida | G09G 3/16 345/214 |

(Continued)

FOREIGN PATENT DOCUMENTS

| | | |
|---|---|---|
| EP | 1 750 242 A2 | 2/2007 |
| JP | 2008-268853 A | 11/2008 |
| JP | 2009-103967 A | 5/2009 |

*Primary Examiner* — Andrew Sasinowski
*Assistant Examiner* — Chineyere Wills-Burns

(57) ABSTRACT

An electrophoretic display device includes a display unit including two substrates and an electrophoretic element containing electrophoretic particles disposed between the two substrates, and able to display at least a first color and a second color; a processor unit having a first mode and a second mode of lower power consumption than the first mode; a time information generating unit that generates time information; and a drawing unit that displays an image on the display unit. The time information generating unit includes a timer that counts time, and sends a counting completed signal to the processor unit when the timer counts a specific image; and the processor unit goes from the first mode to the second mode after starting counting by the timer in the first mode, and when the counting completed signal is then received, goes from the second mode to the first mode.

13 Claims, 14 Drawing Sheets

(56) References Cited

U.S. PATENT DOCUMENTS

2011/0102480 A1* 5/2011 Miyasaka ..... G04G 9/0005
345/690
2014/0071183 A1* 3/2014 Murayama ..... G09G 3/344
345/690

* cited by examiner

| TEMPERATURE T | MAIN DRIVE TIME $t_{main}$ | ADJUSTMENT DRIVE TIME $t_{adj}$ | DISCHARGE TIME $t_{dis}$ | TOTAL TIME $t_{total}$ ($t_{main}+t_{adj}+t_{dis}$) |
|---|---|---|---|---|
| $T \leqq T_1$ | $A_1$ | $B_1$ | $C_1$ | $D_1(=A_1+B_1+C_1)$ |
| $T_1 < T \leqq T_2$ | $A_2$ | $B_2$ | $C_2$ | $D_2(=A_2+B_2+C_2)$ |
| $T_2 < T \leqq T_3$ | $A_3$ | $B_3$ | $C_3$ | $D_3(=A_3+B_3+C_3)$ |
| $T_3 < T \leqq T_4$ | $A_4$ | $B_4$ | $C_4$ | $D_4(=A_4+B_4+C_4)$ |
| $T_4 < T \leqq T_5$ | $A_5$ | $B_5$ | $C_5$ | $D_5(=A_5+B_5+C_5)$ |
| $T_5 < T$ | $A_6$ | $B_6$ | $C_6$ | $D_6(=A_6+B_6+C_6)$ |

FIG. 9

ELECTROPHORETIC DISPLAY DEVICE, ELECTRONIC TIMEPIECE, AND OPERATING METHOD OF AN ELECTROPHORETIC DISPLAY DEVICE

BACKGROUND

1. Technical Field

The present invention relates to an electrophoretic display device, an electronic timepiece, and an operating method of an electrophoretic display device.

2. Related Art

Display panels known as electrophoretic display (EPD) panels capable of continuing to display an image even when the power is turned off have been developed, and practical electrophoretic display devices using such EPD panels are widely available. Because an EPD panel can retain the displayed image for a certain period of time even when power is not supplied, enabling low power consumption operation, and EPD panels can also provide a 180-degree viewing angle, wristwatches using electrophoretic display devices (called EPD watches below) have also been developed. Technology related to EPD watches is disclosed in JP-A-2009-103967, for example.

An example of a function block diagram of an EPD watch according to the related art is shown in FIG. 14. As shown in FIG. 14, an EPD watch according to the related art has a customized microcontroller (MCU) specifically designed as a processor for an EPD watch to achieve low power consumption, and the MCU includes the function of a real-time clock (RTC) using a crystal oscillator as the master clock and controls displaying the time on the EPD panel.

However, because the program controlling operation of a conventional EPD watch is rendered by a mask ROM (read-only memory) and must be fixed when the MCU is manufactured, assuring sufficient time for program development may be difficult. In addition, if the specifications change after the program is fixed, the MCU must be redesigned, and shortening the development time and reducing cost are also difficult. Using a more versatile MCU that does not rely on a mask ROM as the processor of the EPD watch is therefore desirable, but optimizing the process of an existing general purpose MCU having an RTC function is difficult, and increased power consumption when compared with using a custom MCU is unavoidable.

SUMMARY

The present invention is directed to the foregoing problem and provides an electrophoretic display device, an electronic timepiece, a wristwatch, and an operating method of an electrophoretic display device that can suppress an increase in power consumption.

The present invention solves at least part of the foregoing problem as described in the following embodiments and examples.

Example 1

An electrophoretic display device according to this aspect of the invention includes a display unit including two substrates and an electrophoretic element containing electrophoretic particles disposed between the two substrates, and able to display at least a first color and a second color; a processor unit having a first mode and a second mode of lower power consumption than the first mode; a time information generating unit that generates time information; and a drawing unit that displays an image on the display unit. The time information generating unit includes a timer that counts time, and sends a counting completed signal to the processor unit when the timer counts a specific image; and the processor unit goes from the first mode to the second mode after starting counting by the timer in the first mode, and when the counting completed signal is then received, goes from the second mode to the first mode.

Because the processor unit in the electrophoretic display device according to this example goes from a first mode to a second mode that consumes less power, increased power consumption can be suppressed.

Example 2

In an electrophoretic display device according to another aspect of the invention, the drawing unit displays an image on the display unit on a specific cycle; and one period in the specific cycle includes a period in which the processor unit is in the second mode.

Because the processor unit displays an image on the display unit in a specific period including time in the second mode, the electrophoretic display device according to this example can effectively reduce power consumption.

Example 3

In an electrophoretic display device according to another aspect of the invention, the specific cycle is a cycle for displaying an image containing time information; the processor unit sends drawing information for the image to display on the display unit to the drawing unit in the first mode; and the drawing unit displays the image containing time information on the display unit based on the drawing information.

The electrophoretic display device according to this example can cyclically display an image containing time information while effectively reducing power consumption.

Example 4

In an electrophoretic display device according to another aspect of the invention, in the first mode, the processor unit receives a flag signal indicating the draw timing from the time information generating unit, and controls the timing when the drawing unit displays the image on the display unit based on the received flag signal.

In the electrophoretic display device according to this example, the processor unit can display an image on the display unit at a time synchronized to the flag signal received from the time information generating unit.

Example 5

An electrophoretic display device according to another aspect of the invention also has a temperature measuring unit; and in the first mode, the processor unit gets temperature information from the temperature measuring unit, and controls the timing for sending drawing information for the image to display on the display unit to the drawing unit based on the acquired temperature information.

In the electrophoretic display device according to this example, the processor unit can adjust the timing for displaying an image on the display unit according to the temperature.

Example 6

An electrophoretic display device according to another aspect of the invention also has a temperature measuring unit; and in the first mode, the processor unit gets temperature information from the temperature measuring unit, and may control the length of the specific time based on the acquired temperature information.

In the electrophoretic display device according to this example, the processor unit can further decrease wasteful power consumption by adjusting the length of the second mode according to the temperature.

Example 7

In an electrophoretic display device according to another aspect of the invention, the processor unit includes a storage unit rewritably storing program information and command information for the drawing unit; and reads and executes the program information from the storage unit, reads the command information from the storage unit, and sends drawing information of the image to display on the display unit to the drawing unit.

Because the electrophoretic display device according to this example has a processor unit that includes a rewritable storage unit and is highly versatile compared with a custom device, the display image can be changed relatively easily.

Example 8

In an electrophoretic display device according to another aspect of the invention, the processor unit, the time information generating unit, and the drawing unit operate on supply voltage supplied from a primary battery.

Because low power consumption can be achieved with the electrophoretic display device according to this example, operation with a low capacity, low cost primary battery is possible. A small, low cost electronic device can therefore be provided by using the electrophoretic display device according to the invention.

Example 9

Another aspect of the invention is an electronic timepiece including the electrophoretic display device described above.

Example 10

Another aspect of the invention is a wristwatch including the electrophoretic display device described above.

An electronic timepiece or a wristwatch having a long operating time and good ease of use can be provided by using the low power consumption electrophoretic display device according to the invention.

Example 11

Another aspect of the invention is an operating method of an electrophoretic display device, the electrophoretic display device including a display unit having two substrates and an electrophoretic element containing electrophoretic particles disposed between the two substrates, and able to display at least a first color and a second color, a processor unit having a first mode and a second mode that consumes less power than the first mode, a time information generating unit including a timer that counts time and generating time information, and a drawing unit that displays an image on the display unit. The operating method includes: the processor unit starting counting by the timer in the first mode; the processor unit sending drawing information of an image to display on the display unit to the drawing unit in the first mode; the drawing unit displaying the image on the display unit based on the drawing information; the processor unit going from the first mode to the second mode; the time information generating unit sending a counting completed signal to the processor unit when the timer counts a specific time; and the processor unit going from the second mode to the first mode when the counting completed signal is received.

Because the processor unit goes from a first mode to a second mode that consumes less power, increased power consumption by the electrophoretic display device can be suppressed by the operating method of an electrophoretic display device according to this example.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 9 shows an example of a data table showing the correlation between temperature and the drive pulse on time.

DESCRIPTION OF EMBODIMENTS

Preferred embodiments of the present invention are described below with reference to the accompanying figures. Note that the embodiments described below do not unduly limit the scope of the invention as described in the accompanying claims. All elements in the configurations described below are also not essential to the invention.

Embodiment 1

Summary of an Electronic Timepiece

Figure 1:
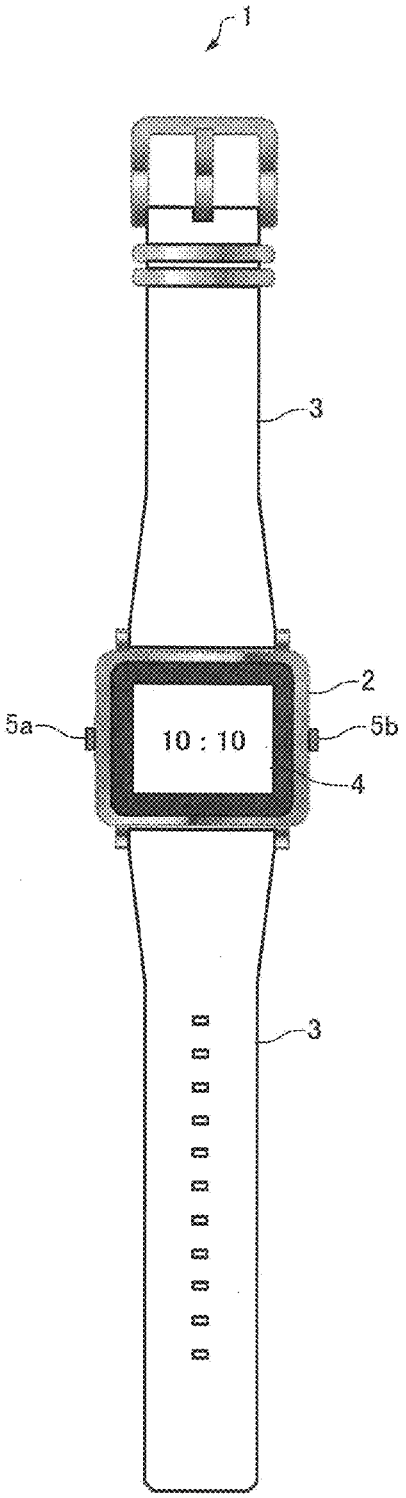
FIG. 1 shows the appearance of an electronic timepiece according to an embodiment of the invention.

FIG. 1 illustrates an example of an electronic timepiece 1 according to this embodiment, and is a plan view of the electronic timepiece 1 perpendicularly to the display unit from the side (the front) from which the display unit can be seen. As shown in FIG. 1, the electronic timepiece 1 according to this embodiment is a wristwatch, and has a timepiece case 2 and a pair of wristbands 3 connected to the timepiece case 2.

A display unit 4 embodied by an electrophoretic display (EPD) panel is disposed to the front of the timepiece case 2, and operating button A 5*a* and operating button B 5*b* are disposed to the side (the direction perpendicular to the front) of the timepiece case 2.

Images, such as images including time information that is updated every minute or every second, and an image for adjusting the time, are displayed on the display unit 4 in response to depression (input operation) of operating button A 5*a* or operating button B 5*b*.

An electrophoretic display device (of which only the display unit is shown) including the display unit 4 and a drive device (not shown in the figure) that drives the display unit 4 is disposed inside the timepiece case 2.

Configuration of an Electrophoretic Display Device

Figure 2:
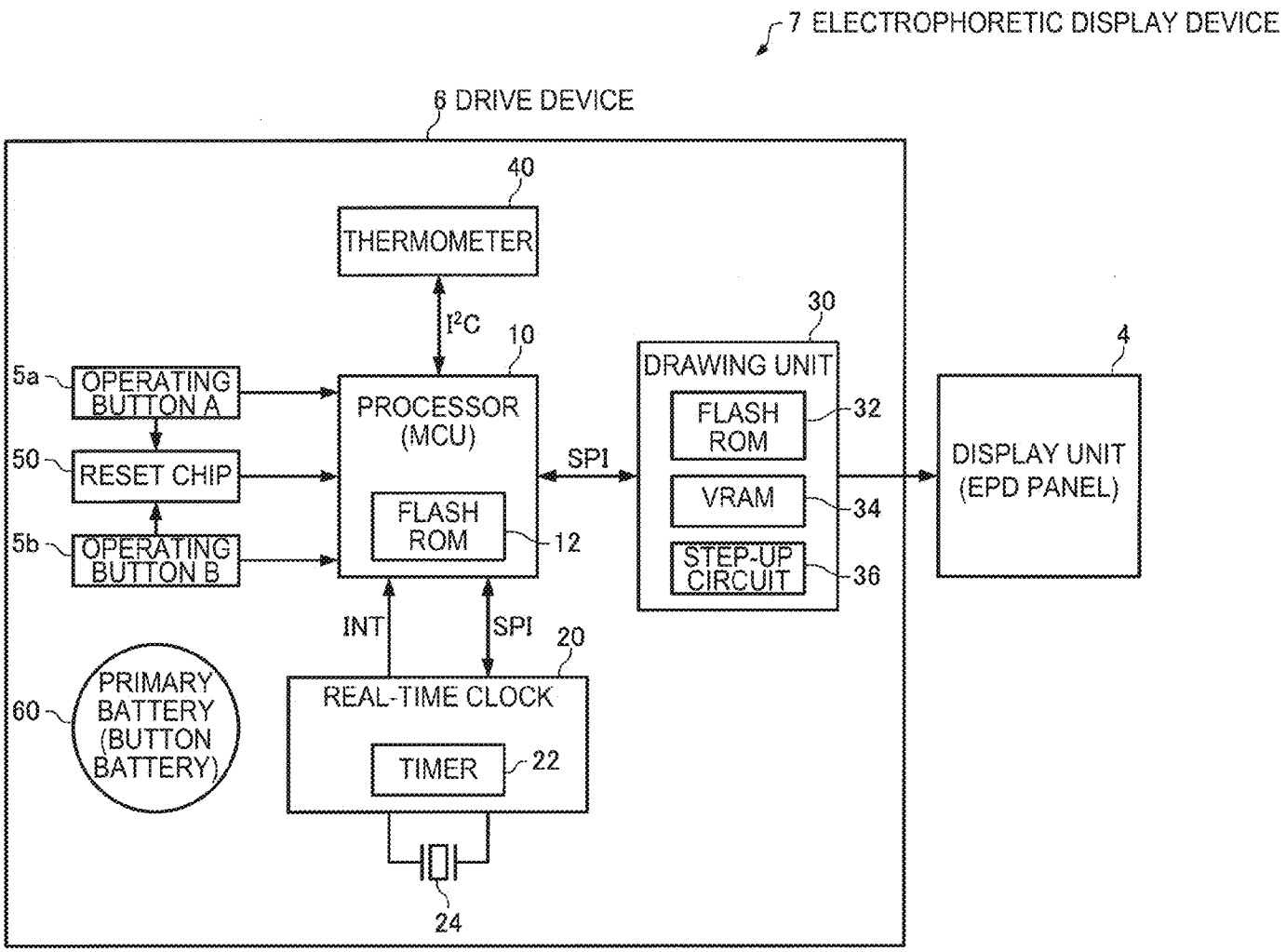
FIG. 2 is a function block diagram of an electrophoretic display device according to an embodiment of the invention.

FIG. 2 is a function block diagram of the electrophoretic display device used in a electronic timepiece 1 according to this embodiment. As shown in FIG. 2, the electrophoretic display device 7 of the electronic timepiece 1 according to this embodiment includes a display unit 4 (see FIG. 1) and a drive device 6, and the drive device 6 includes a processor chip (integrated circuit device) 10, a real-time clock chip 20, a drawing chip 30, a thermometer chip 40, and a reset chip 50. As described below, by achieving low power consumption operation of these chips and the display unit 4, the electrophoretic display device 7 in this embodiment of the invention can continue operating for several years using a low capacity primary battery 60 such as a button battery. Note that the electrophoretic display device 7 may alternatively be configured to operate with a rechargeable battery (storage battery).

In this embodiment, the processor chip 10 (an example of a processor unit) is rendered using a highly versatile microcontroller (MCU) with internal rewritable flash ROM 12, and operates according to a program and data stored in the flash ROM 12. The function of the processor chip 10 can therefore be easily changed by rewriting the program or data stored in the flash ROM 12. Furthermore, because the program or data can be rewritten based on the state of the movement (timepiece drive device) in which the processor chip 10 is incorporated, program changes can also be easily accommodated.

The processor chip 10 runs a process that determines the mode and type of image displayed on the display unit 4 in response to depression (input operation) of operating button A 5*a* or operating button B 5*b*. The modes identified by the processor chip 10 in this embodiment include, for example, a minute update mode in which an image including a time display that is updated every minute is displayed on the display unit 4, a second update mode in which an image including a time display that is updated every second is displayed on the display unit display unit 4, and a time adjustment (setting) mode in which the time displayed on the display unit 4 is advanced or reversed in response to depression (input operation) of operating button A 5*a* or operating button B 5*b*.

In the minute update mode and second update mode, for example, the processor chip 10 executes a process of getting time information such as the date and time from the real-time clock chip 20 and determining the content to display on the display unit 4, and in the time adjustment mode, executes a process of sending a time adjustment value corresponding to depression (input operation) of the operating button A 5*a* or operating button B 5*b* to the real-time clock chip 20.

A macro command for deleting the image displayed on the display unit 4 (delete image macro command), and a macro command for drawing a new image on the display unit 4 (draw new image macro command), are stored in the flash ROM 12 (an example of a rewritable storage unit). The processor chip 10 executes a process of reading and sending the desired macro command (an example of command information) from the flash ROM 12 to the drawing chip 30 at a specific time.

The processor chip 10 also executes a process of sending image data from the drawing chip 30 to the display unit 4, and a process causing the drawing chip 30 to drive the display unit 4. The processor chip 10 also supplies a reference signal (such as 4 kHz) for driving the display unit 4 to the drawing chip 30.

When a reset signal is supplied from the reset chip 50, the processor chip 10 executes an initialization process that unconditionally enters the time adjustment mode, for example.

The processor chip 10 also executes a process of supplying power to the thermometer chip 40 (an example of a temperature measurement unit), a process of reading the measured temperature from the thermometer chip 40, and a process of determining the on time and the on timing of the drive pulse to the thermometer chip 40 based on the read temperature.

In this embodiment of the invention, the processor chip 10 has a normal operating mode (an example of a first mode) and a sleep mode (an example of a second mode). In the normal operating mode, the processor chip 10 operates synchronized to a clock signal output by an internal oscillator circuit (such as a capacitor resistor oscillator circuit composed of a capacitor C and a resistor R). In the sleep mode, the oscillator circuit stops and power consumption is lower than in the normal operating mode. To achieve low power consumption, the processor chip 10 operates in the normal operating mode when executing the processes (the above processes) for updating the display of the display unit 4, and when not executing a process, saves the current mode information and data being used to RAM (random access memory (not shown in the figure)) incorporated in the processor chip 10, and waits in the sleep mode. For example, when the minute update mode is selected, the processor chip 10 sends drawing information (macro command) of the image to be displayed on the display unit 4 to the drawing chip 30 while in the normal operating mode, starts the timer 22 included in the real-time clock chip 20, and then enters the sleep mode. In the sleep mode, the processor chip 10 returns to the normal operating mode when an interrupt signal INT (counting completed signal) indicating that the timer 22 has counted the specified time is received from the real-time clock chip 20.

The processor chip 10 may also execute a process that reads the measured temperature from the thermometer chip 40 and determines if the high temperature limit or the low temperature limit at which normal operation is possible was reached, and a process that monitors the voltage of the primary battery 60 and determines if a low voltage limit was reached.

In this embodiment of the invention the processor chip 10 executes processes by running a program previously stored in flash ROM 12, but may receive a program through a network from a server connected to a network, and store and run the program from internal memory. Further alternatively, the electronic timepiece 1 may be configured to connect to a memory card or other data storage medium, and the processor chip 10 execute processes by running a program stored on the data storage medium.

The real-time clock chip 20 (an example of a time information generating unit) drives the crystal oscillator 24 to generate an oscillator signal at 32,768 kHz, for example; keeps the time including the second, minute, and hour, and the date including the day, month, and year based on clock signals acquired by frequency dividing the oscillator signal; and generates time information including the second, minute, hour, day, month, and year, for example. This time information is stored in a register (not shown in the figure) in the real-time clock chip 20, and in response to a request from the processor chip 10, the real-time clock chip 20 sends all or part of the time information stored in the register to the processor chip 10.

In response to a request from the processor chip 10, the real-time clock chip 20 also starts counting by the timer 22, and when the timer 22 finishes counting, sends the interrupt signal INT (counting completed signal) to the processor chip 10. The time that the timer 22 counts may be a constant time, or a time specified by the processor chip 10.

The drawing chip 30 (an example of a drawing unit) executes a process of writing image data for erasing the current image to VRAM (video RAM) 34 in the drawing chip 30 in response to a delete image macro command from the processor chip 10; and a process of writing image data for displaying a new image to VRAM 34 in the drawing chip 30 in response to a draw new image macro command from the processor chip 10.

The drawing chip 30 also executes a process of supplying power to the display unit 4 and sending the image data written to VRAM 34 to the display unit 4; and a process of boosting the external supply voltage (such as 5 V) by the step-up circuit 36 in the drawing chip 30 to generate a high voltage (such as 15 V) drive pulse, and driving the display unit 4.

Parts data for the images displayed on the display unit 4 (components such as a 1, 0, and other elements for displaying content such as shown in FIG. 1), and background data, are stored in the flash ROM 32 of the drawing chip 30. Information of the image parts to be drawn and the coordinates (such as the coordinates of the origin of each image part), or information of the background data to be drawn, is also included in the delete image macro command and draw new image macro command sent from the processor chip 10.

The drawing chip 30 then reads the parts data stored in the flash ROM 32, and writes the selected parts to the address in VRAM 34 corresponding to the display coordinates in the display area of the display unit 4, or reads and writes the background data stored in flash ROM 32 to a specific address in VRAM 34, based on the delete image macro command or draw new image macro command.

Using a reference signal (such as 4 kHz) supplied from the processor chip 10, the drawing chip 30 also adjusts the on (transmission) timing and pulse width of the drive pulse. The drawing chip 30 also has an in-built oscillator circuit (not shown in the figure) such as a CR oscillator circuit, generates a clock signal of a relatively high frequency (such as 400 kHz) by means of the oscillator circuit, and executes the above processes except for the drive pulse generating process. The drawing chip 30 can thus enable low power consumption operation by adjusting the on (transmission) timing and pulse width of the drive pulse using a reference signal with a frequency (such as 4 kHz) sufficiently lower than the clock signal produced by the internal oscillator circuit.

Note that when the minute update mode is selected, the real-time clock chip 20 sends a 00-second flag signal to the processor chip 10 at precisely the 00 second of each minute (an example of the draw timing). The processor chip 10 receives this flag signal and instructs the drawing chip 30 to apply (send) the drive pulse to the display unit 4. The drawing chip 30 then applies (sends) the drive pulse to the display unit 4 when this command is received, and the display unit 4 receives the drive pulse and displays a new image (an image including the time 1 minute later than the displayed time). By thus synchronizing the screen update of the display unit 4 to a precise flag signal sent by the real-time clock chip 20 in the minute update mode, the displayed time can start changing at a more accurate time than when synchronizing with an asynchronous clock signal generated by the drawing chip 30.

The thermometer chip 40 operates with power supplied from the processor chip 10, and executes a processing of measuring the temperature in response to a request from the processor chip 10, converting the temperature measurement by an A/D converter (not shown in the figure) in-built to the thermometer chip 40, and outputting to the processor chip 10.

When the operating button A 5*a* and operating button B 5*b* are pressed in a specific way (such as being simultaneously pressed for a long time exceeding a specific duration), the reset chip 50 generates a reset signal for a specific time by means of a CR circuit (not shown in the figure) in the reset chip 50, and supplies the reset signal to the processor chip 10.

Configuration of the Display Unit and Drawing Chip

Figure 3:
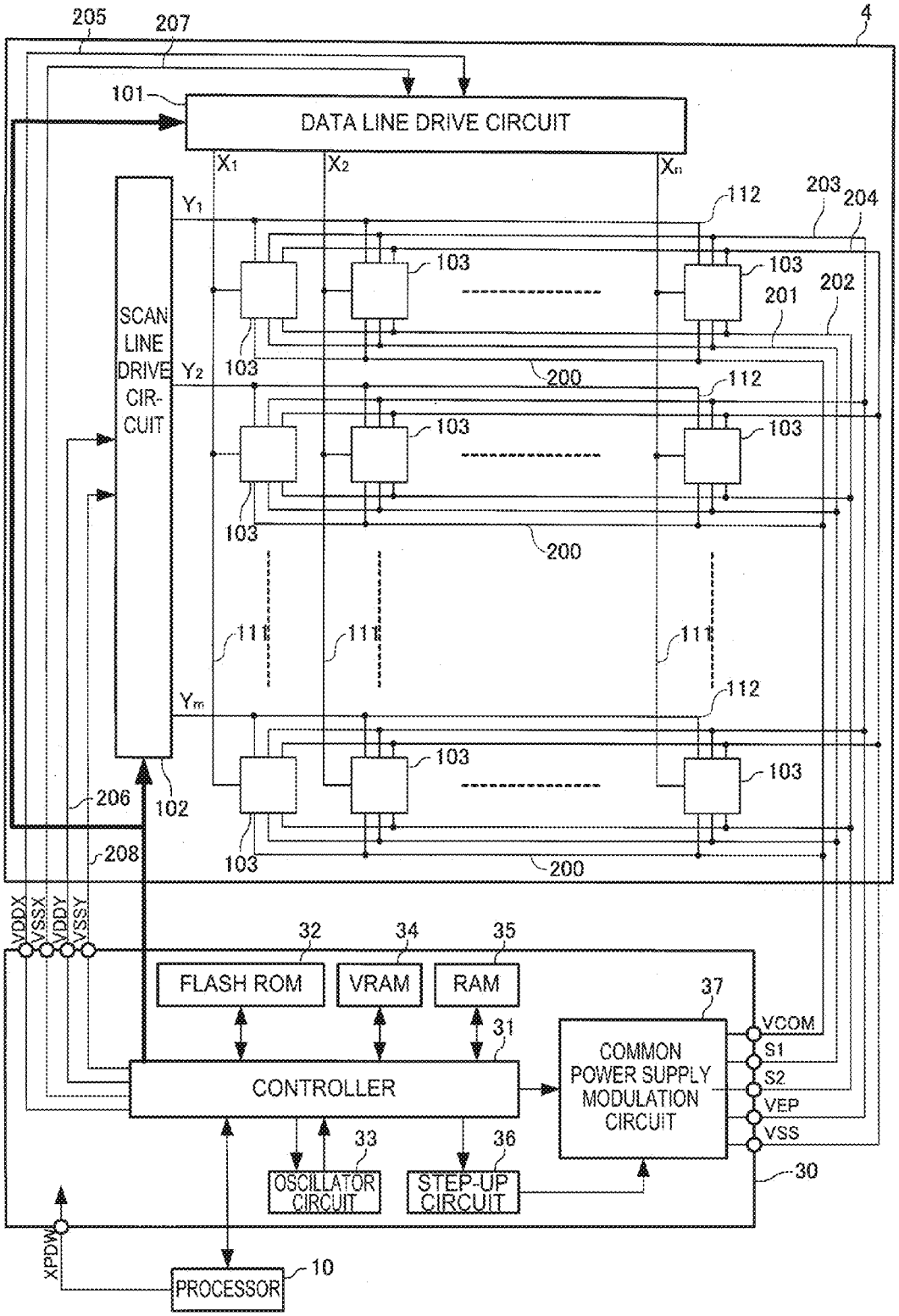
FIG. 3 illustrates the configuration of the display unit and drawing chip of an embodiment of the invention.

FIG. 3 shows the configuration of the display unit 4 and the drawing chip 30 in this embodiment of the invention. As shown in FIG. 3, the display unit 4 according to this embodiment is an active matrix electrophoretic display panel (EPD panel), and can display many different images, including text, numbers, pictures, patterns, and illustrations.

The display unit 4 has a data line drive circuit 101 and a scan line drive circuit 102. The display unit 4 also has multiple data lines 111 extending from the data line drive circuit 101, and multiple scan lines 112 extending from the scan line drive circuit 102, and multiple pixels 103 are rendered at the intersections of these lines.

The data line drive circuit 101 is connected to the pixels 103 by n data lines 111 ($X_1, X_2, \ldots, X_n$). The data line drive circuit 101 supplies the pixels 103 with an image signal specifying 1-bit image data corresponding to each pixel 103 as controlled by the controller 31 in the drawing chip 30. Note that in this example the data line drive circuit 101 supplies a low level image signal to set a pixel 103 to a pixel value of 0, and supplies a high level image signal to set a pixel 103 to a pixel value of 1.

The scan line drive circuit 102 is connected to the pixels 103 by m scan lines 112 ($Y_1, Y_2, \ldots, Y_m$). The scan line drive circuit 102 supplies a selection signal specifying the on timing of the drive TFT 104 (see FIG. 4) disposed to each pixel 103 by sequentially selecting the scan lines 112 from line 1 to line m as controlled by the controller 31.

A high potential supply line 205 that goes from the controller 31 through the VDDX pin of the drawing chip 30 is disposed to the display unit 4, and this high potential supply line 205 is connected to the data line drive circuit 101. A high potential supply line 206 that goes from the controller 31 through the VDDY pin of the drawing chip 30 is also disposed to the display unit 4, and this high potential supply line 206 is connected to the scan line drive circuit 102. The controller 31 controls whether or not to supply the high potential (5 V) to the high potential supply lines 205, 206.

A low potential supply line 207 that goes from the controller 31 through the VSSX pin of the drawing chip 30 is also disposed to the display unit 4, and this low potential supply line 207 is connected to the data line drive circuit 101. A low potential supply line 208 that goes from the controller 31 through the VSSY pin of the drawing chip 30 is also disposed to the display unit 4, and this low potential supply line 208 is connected to the scan line drive circuit 102. The controller 31 supplies the low potential (0 V) to the low potential supply lines 207, 208.

A common electrode line 200, a first pulse signal line 201, a second pulse signal line 202, a high potential supply line 203, and a low potential supply line 204 that go from the common power supply modulation circuit 37 respectively through the VCOM, S1, S2, VEP, and VSS pins of the drawing chip 30, and are connected to each pixel 103, are also disposed to the display unit 4. The common power supply modulation circuit 37 generates the signals supplied to the respective lines as controlled by the controller 31, and electrically connects and disconnects (sets to a high impedance state, Hi-Z) individual lines.

The drawing chip 30 includes the controller 31, flash ROM 32, oscillator circuit 33, VRAM 34, RAM 35, step-up circuit 36, and common power supply modulation circuit 37. The controller 31 is in a power off state until an enable signal (high level signal) is input from the processor chip 10 to the enable pin XPDW. When in the power on state, the controller 31 controls the flash ROM 32, oscillator circuit 33, VRAM 34, step-up circuit 36, and common power supply modulation circuit 37 using RAM 35 as working memory, and executes processes for displaying images on the display unit 4.

Figure 4:
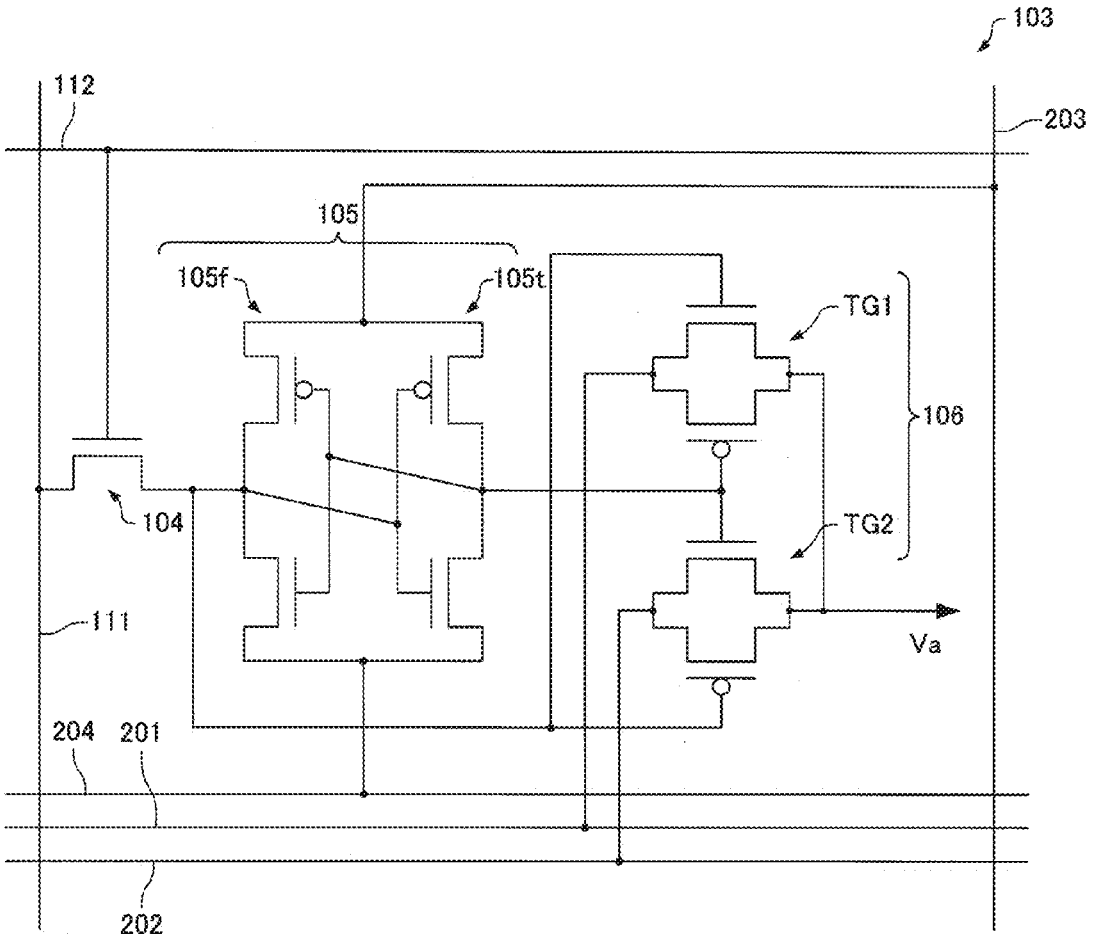
FIG. 4 illustrates the configuration of a pixel circuit in this embodiment of the invention.

FIG. 4 illustrates the circuit configuration of a pixel 103 shown in FIG. 3. Note that the same lines are identified by the same reference numerals in FIG. 3 and FIG. 4, and further description thereof is omitted. The common electrode line 200 that is common to all pixels is also not shown.

As shown in FIG. 4, a drive TFT (thin film transistor) 104, latch circuit 105, and switch circuit 106 are disposed to each pixel 103. The pixel 103 has an SRAM (Static Random Access Memory) configuration that holds the potential of the image signal by means of a latch circuit 105.

The drive TFT 104 is pixel switching device comprising an n-MOS (metal oxide semiconductor) transistor. The gate of the drive TFT 104 is connected to the scan lines 112, the source is connected to the data lines 111, and the drain is connected to the data input node of the latch circuit 105. The latch circuit 105 includes a transfer inverter 105*t* and a feedback inverter 105*f*. A supply voltage equivalent to the potential difference of the high potential supply line 203 and low potential supply line 204 is supplied to the transfer inverter 105*t* and feedback inverter 105*f*.

The switch circuit 106 comprises transmission gates TG1, TG2, and outputs a signal to the pixel electrode 135 (see FIG. 5B, FIG. 5C) according to the level of the pixel data stored in the latch circuit 105.

When the pixel value 1 (high level image signal) is stored in the latch circuit 105 and transmission gate TG1 goes on, the switch circuit 106 outputs a signal that propagates to the first pulse signal line 201. When the pixel value 0 (low level image signal) is stored in the latch circuit 105 and transmission gate TG2 goes on, the switch circuit 106 outputs a signal that propagates to the second pulse signal line 202. The potential supplied to the pixel electrode 135 of each pixel 103 can thus be controlled by this circuit design.

Figure 5A:
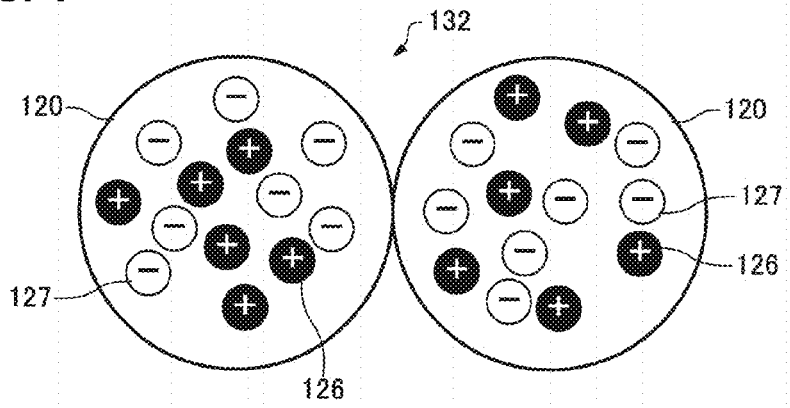
FIG. 5A illustrates the configuration of an electrophoretic display element.

This embodiment of the invention has multiple electrophoretic elements of a two particle microcapsule type, and the color of each pixel 103 is controlled by applying an electrical field to each electrophoretic element. FIG. 5A illustrates the configuration of an electrophoretic element 132 in this embodiment of the invention. The electrophoretic element 132 is disposed between a device substrate 130 and an opposing substrate 131 (see FIG. 5B, FIG. 5C). The electrophoretic element 132 is composed of an array of multiple microcapsules 120. Multiple white electrophoretic particles (white particles 127) and multiple black electrophoretic particles (black particles 126) in a colorless, transparent dispersion are sealed in each microcapsule 120. In this example, the white particles 127 are negatively charged and the black particles 126 are positively charged. Note that the colors of the electrophoretic particles are not limited to black and white, and red and white or other combination of colors may be used.

Note that a material being "colorless" as used herein means that when a subject is seen through that material, the color of the subject is the same as when the subject is seen without looking through that material. A material being "transparent" means that the subject can be seen through the material.

Figure 5B:
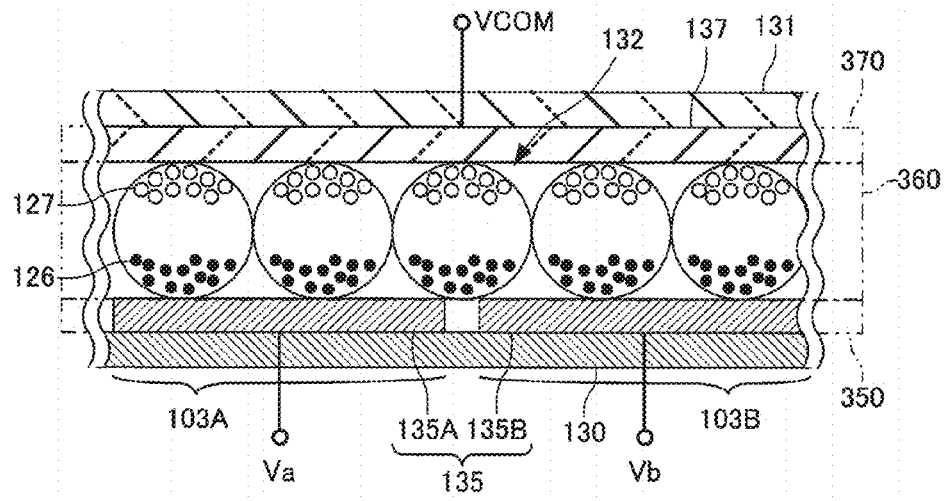
FIG. 5B and FIG. 5C illustrate the operation of an electrophoretic display element.

FIG. 5B is a section view through part of the display unit 4. The electrophoretic element 132 comprising an array of microcapsules 120 is sandwiched between the device substrate 130 and opposing substrate 131. A drive electrode layer 350 comprising a plurality of pixel electrodes 135 is disposed to the display unit 4 on the electrophoretic element 132 side of the device substrate 130. Pixel electrode 135A and pixel electrode 135B are shown as examples of the pixel electrodes 135 in FIG. 5B. A potential (Va and Vb, for example) can be supplied to each pixel by the pixel electrodes 135. In this example, the pixel addressed by pixel electrode 135A is referred to as pixel 103A, and the pixel addressed by pixel electrode 135B is referred to as pixel 103B. Pixel 103A and pixel 103B are two pixels corresponding to pixels 103 (see FIG. 3, FIG. 4).

The opposing substrate 131 is a transparent substrate, and images are displayed on the opposing substrate 131 side of the display unit 4. A common electrode layer 370 in which a planar common electrode 137 is formed is disposed to the display unit 4 on the electrophoretic element 132 side of the opposing substrate 131. The common electrode 137 is a transparent electrode. Unlike the pixel electrodes 135, the common electrode 137 is an electrode common to all pixels, and potential VCOM is supplied thereto.

The electrophoretic elements 132 are disposed in an electrophoretic display layer 360 between the common electrode layer 370 and drive electrode layer 350, and the electrophoretic display layer 360 becomes the display area. The desired color can be displayed in each pixel according to the potential difference between the pixel electrode 135 (such as pixel electrode 135A or 135B) and the common electrode 137.

FIG. 5B illustrates the display state when the potential VCOM on the common electrode 137 side is higher than the potential Va of the pixel electrode 135A of pixel 103A and the potential Vb of the pixel electrode 135B of pixel 103B. In this event, because a negative voltage referenced to potential VCOM is applied between pixel electrodes 135A, 135B and the common electrode 137, the negatively charged white particles 127 are attracted to the common electrode 137 side, and the positively charged black particles 126 are pulled to the pixel electrode 135A, 135B side, and pixels 103A, 103B are seen as displaying white (an example of a first color).

Figure 5C:
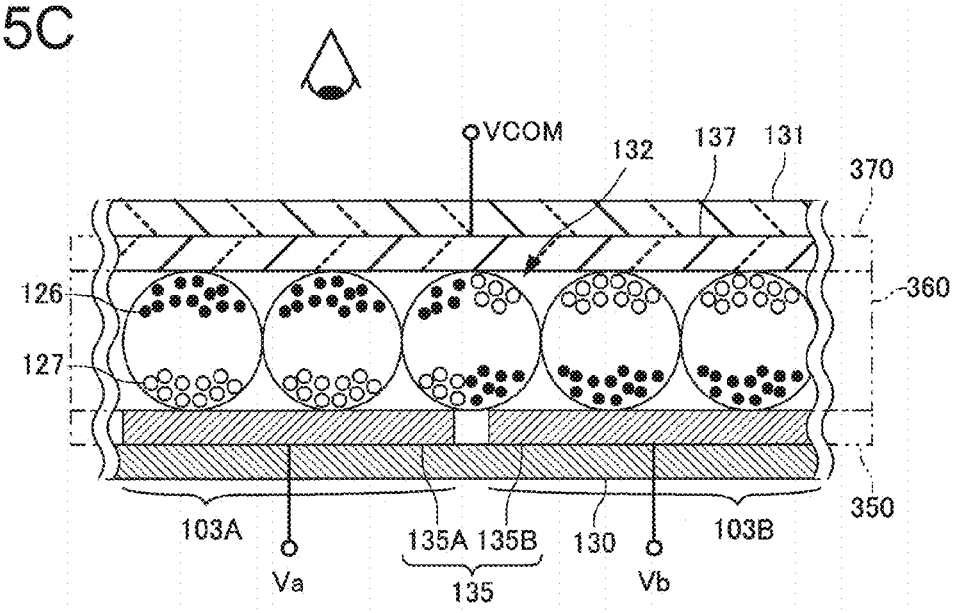

FIG. 5C illustrates the display state when the potential VCOM on the common electrode 137 side changes from the state in FIG. 5B to a lower potential than the potential Va of the pixel electrode 135A of pixel 103A, and the same potential as the potential Vb of the pixel electrode 135B of pixel 103B. In this event, because a positive voltage referenced to potential VCOM is applied between pixel electrode 135A the common electrode 137, the positively charged black particles 126 are pulled to the common electrode 137 side, the negatively charged white particles 127 are attracted to the pixel electrode 135A side, and pixel 103A is seen as having changed from displaying white to black (an example of a second color). Because there is no potential difference between pixel electrode 135B and the common electrode 137, there is substantially no movement in the black particles 126 and white particles 127 from their positions in FIG. 5B, and pixel 103B is seen as not changing and continuing to display white.

Note that a desired intermediate color (gray level) between black and white can be displayed by causing the black particles 126 and white particles 127 to stop at a desired intermediate position between the electrodes by controlling the potential difference or the time a potential difference is applied to the pixel electrode 135 and the common electrode 137.

Because low power consumption operation is possible because the displayed image can be maintained for a specific time without supplying power, and a viewing angle of 180 degrees is possible, the EPD panel is also suited for use as the display unit of a wristwatch or other type of mobile electronic timepiece.

Image Updating Method

Figure 6:
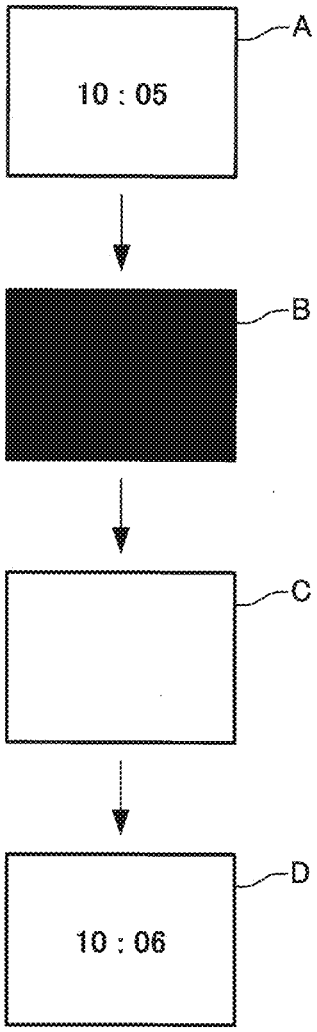
FIG. 6 illustrates a method of updating the image displayed on the display unit in this embodiment of the invention.

FIG. 6 illustrates a method of updating the image on the display unit 4. FIG. 6 shows an example in which the displayed time is updated every minute.

In the example shown in FIG. 6, when the time is initially 10:05, image A in which the pixels at the display positions of 10:05 are black and the other pixels are white is displayed on the display unit 4.

When the time reaches slightly before 10:06, a completely black image B is displayed on the display unit 4. To change from image A to image B, a completely black image is displayed using a partial pixel drive method of not applying voltage to the black pixels (apply 0 V), and applying a negative voltage to the white pixels, and then re-displaying a completely black image using an all pixel drive method that applies a negative voltage to all pixels.

The all pixel drive method is a drive method that produces a potential difference in all pixels (between the common electrode 137 and the pixel electrode 135) during the drive (drawing) period using this method.

Next, a completely white image C is displayed on the display unit 4. To change from image B to image C, a completely white image is first displayed in the all pixel drive method by applying a positive voltage to all pixels, and then re-displaying a completely white image in the partial pixel drive method by applying a positive voltage to the pixels that were black in image A without applying voltage (applying 0 V) to the pixels that were white in image A.

The partial pixel drive method is a drive method in which a potential difference of predetermined pixels is produced in the drive (drawing) period using this method.

When the time then goes to 10:06, image D in which the pixels at the display positions of 10:06 are black and the other pixels are white is displayed on the display unit 4. To change from image C to image D, image D is displayed in the partial pixel drive method by applying a negative voltage to the pixels at the display positions of 10:06 without applying voltage (applying 0 V) to the pixels not at the display positions of 10:06.

This embodiment of the invention thus displays a completely black image by means of a partial pixel drive method and an all pixel drive method, erases the original image by displaying a completely white image by means of the all pixel drive method and the partial pixel drive method, and then displays the next image (new image) by means of the partial pixel drive method.

Figure 7:
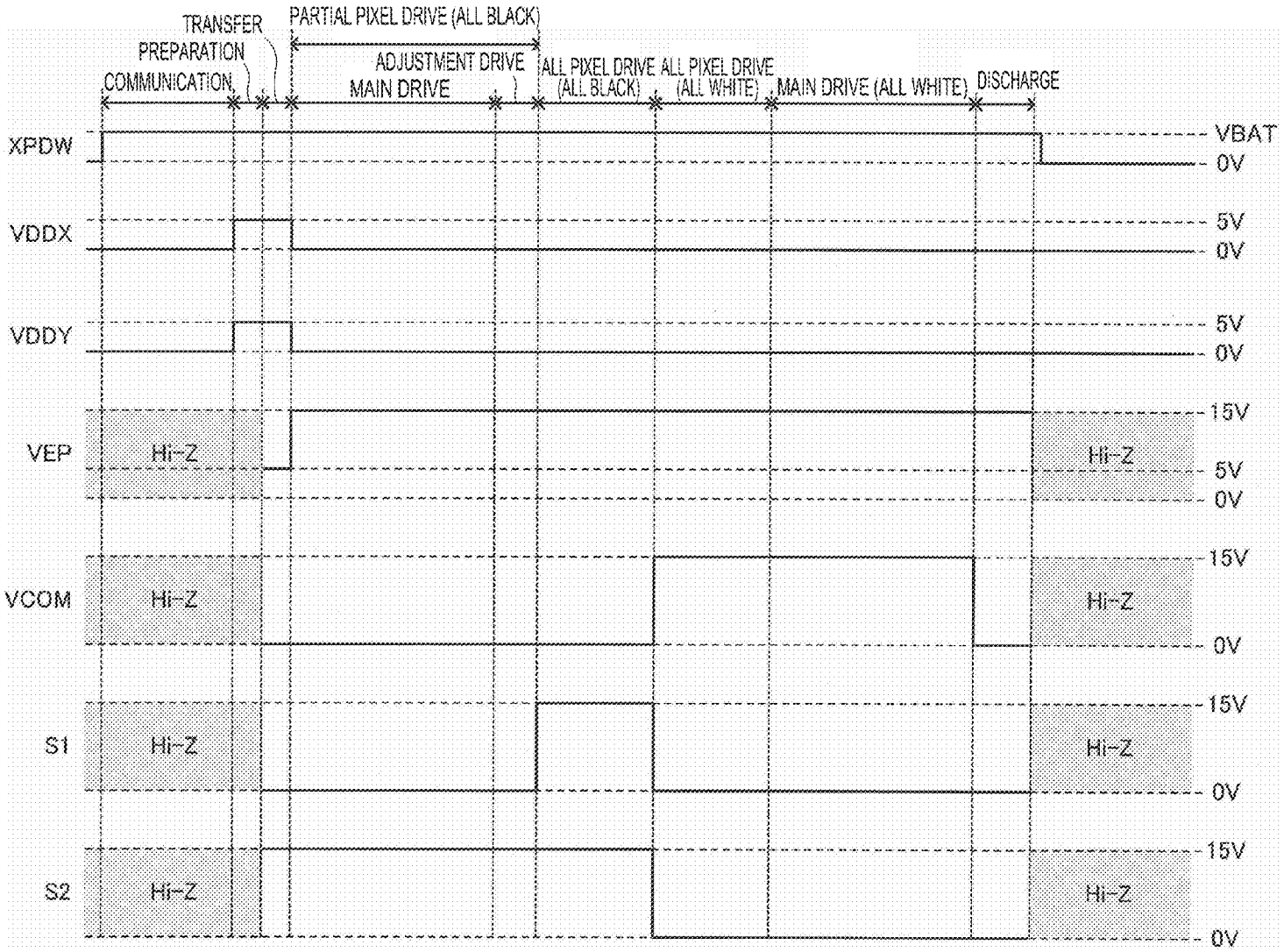
FIG. 7 illustrates an example of the voltage waveforms at terminals of the drawing chip when erasing an image.

FIG. 7 shows an example of the voltage waveforms at pins of the drawing chip 30 (see FIG. 3) when erasing the currently displayed image, and corresponds to the voltage waveforms for displaying image B and then image C when image A in FIG. 6 is displayed.

As shown in FIG. 7, when an enable signal is first input from the processor chip 10, enable pin XPDW goes from 0 V to the output voltage VBAT of the primary battery 60, and the drawing chip 30 goes from the power off mode to the power on mode. When the drawing chip 30 turns on, the step-up circuit 36 starts voltage boosting.

When the drawing chip 30 is on, it communicates with the processor chip 10 and receives the delete image macro command from the processor chip 10.

Next, the drawing chip 30 goes to a preparation state to read and merge parts data or background data from the flash ROM 32 according to the macro command, and writes black/white inversion image data for the current image to VRAM 34. When changing from the communication state to the preparation state, the VDDX pin and VDDY pin go to 5 V, enabling the data line drive circuit 101 and scan line drive circuit 102 of the display unit 4 to operate.

Next, the drawing chip 30 goes to the transfer state, and transfers the image data written to VRAM 34 to the data line drive circuit 101 and scan line drive circuit 102 of the display unit 4. The data line drive circuit 101 and scan line drive circuit 102 of the display unit 4 control the voltage level of the n data lines 111 and the voltage level of the m scan lines 112 according to the transferred image data. The output voltage of the step-up circuit 36 rises to 15 V before going from the preparation state to the transfer state, and to enter the transfer state, the VEP pin goes to 5 V, the VCOM pin and S1 pin go to 0 V, and the S2 pin goes to 15 V.

Next, the drawing chip 30 sets the voltage of the VEP pin to 15 V and goes to the main drive state; the 0 V voltage of the VCOM pin is applied to the common electrode 137; the 0 V voltage of the S1 pin is applied to the pixel electrodes 135 of the black pixels; and the 15 V of the S2 pin is applied to the pixel electrodes 135 of the white pixels. As a result, the potential difference between the common electrode 137 and the pixel electrodes 135 of the black pixels is 0 V, the potential difference between the common electrode 137 and the pixel electrodes 135 of the white pixels becomes +15 V, and the white pixels change to black by the partial pixel drive method.

The drawing chip 30 then enters the adjustment drive state while the VCOM pin remains at 0 V, the S1 pin voltage at 0 V, and the S2 pin voltage at 15 V. Driving in the partial pixel drive method is used in the adjustment drive state to maintain a DC balance with partial pixel drive in the adjustment drive state when drawing a new image (updated image) as described below.

Next, the drawing chip 30 sets the voltage of the VCOM pin to 0 V, and the voltage of the S1 and S2 pins to 15 V, and changes to the all pixel drive state to display a completely black screen. In this all pixel drive state, the potential difference between the common electrode 137 and the pixel electrodes 135 of all pixels goes to +15 V, and a completely black image is re-displayed by the all pixel drive method.

Next, the drawing chip 30 sets the voltage of the VCOM pin to 15 V, and the voltage of the S1 and S2 pins to 0 V, and changes to the all pixel drive state to display a completely white screen. For a DC balance in this all pixel drive state with all pixel drive in the all pixel drive state for displaying a completely black screen, the potential difference between the common electrode 137 and the pixel electrodes 135 of all pixels goes to −15 V, and a completely white image is re-displayed by the all pixel drive method.

Next, the drawing chip 30 goes to the main drive state for displaying a completely white image with the voltage of the VCOM pin held at 15 V, and the voltage of the S1 and S2 pins at 0 V. For a DC balance with partial pixel drive in the main drive state when drawing a new image (updated image) (see FIG. 8) and partial pixel drive in the main drive state (all black display) when erasing an image (see FIG. 7) as described below, driving by the all pixel drive method is used in the main drive state.

Next, the drawing chip 30 sets the voltage of the VCOM pin, S1 pin, and S2 pin to 0 V, and goes to the discharge state. In the discharge state, the charge accumulated between the pixel electrodes 135 and the common electrode 137 is cleared, and the field between the pixel electrodes 135 and the common electrode 137 goes to 0.

Finally, the drawing chip 30 sets the VEP pin, VCOM pin, S1 pin, and S2 pin to the Hi-Z state, sets the enable pin XPDW to 0 V, and ends the process of clearing the image.

Figure 8:
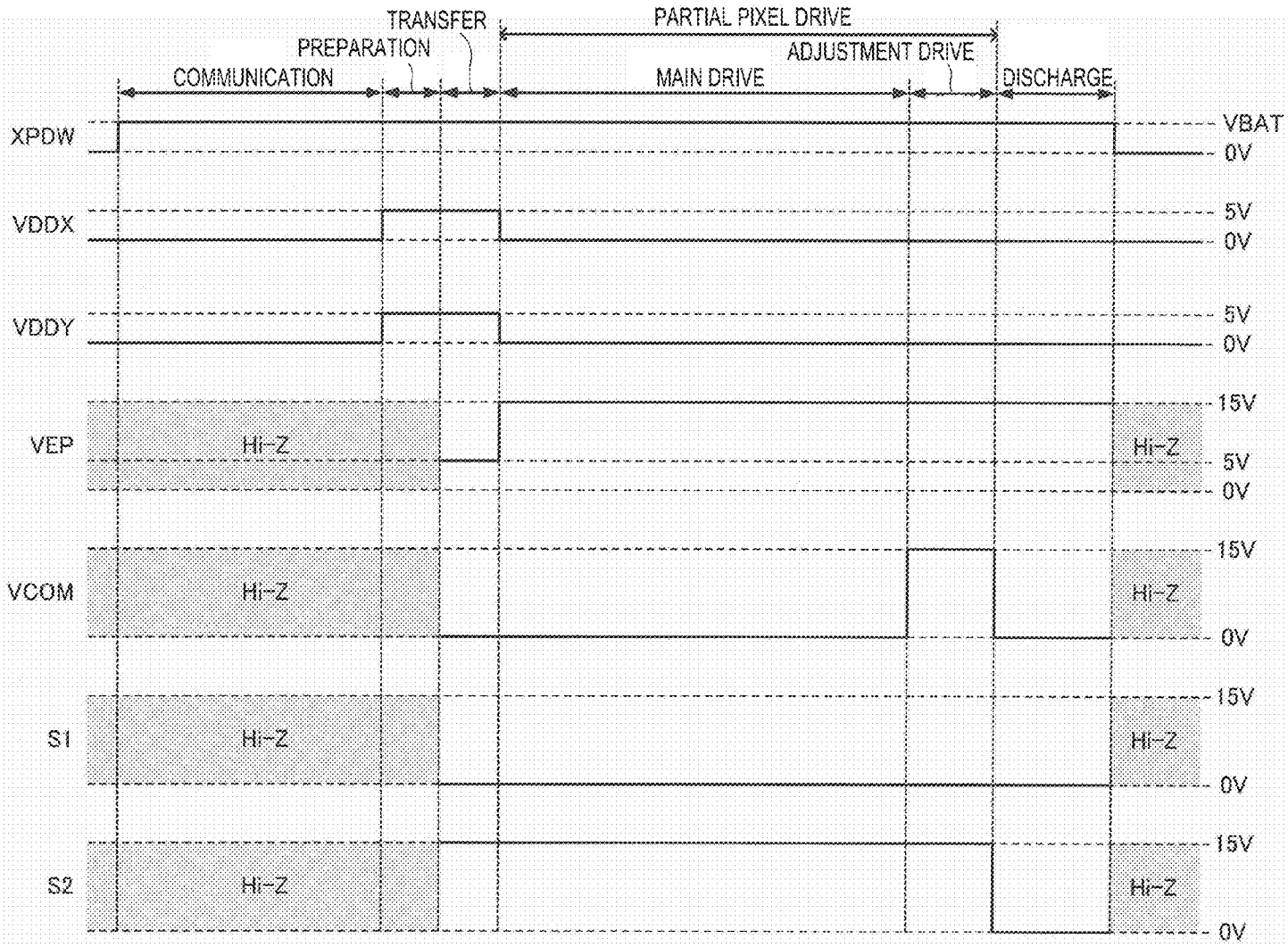
FIG. 8 illustrates an example of the voltage waveforms at terminals of the drawing chip when drawing a new image.

FIG. 8 shows an example of the voltage waveforms at pins of the drawing chip 30 when drawing a new image (update image) updating the currently displayed image, and corresponds to the voltage waveforms for displaying image D when image C in FIG. 6 is displayed. Note that content that is the same in FIG. 8 as in FIG. 7 is omitted or simplified below.

As shown in FIG. 8, the enable pin XPDW first goes from 0 V to VBAT, the drawing chip 30 turns on and communicates with the processor chip 10, and receives the draw new image macro command from the processor chip 10.

Next, the drawing chip 30 goes to a preparation state to read and merge parts data or background data from the flash ROM 32 according to the macro command, and writes image data for the new image to VRAM 34.

Next, the drawing chip 30 goes to the transfer state, and transfers the image data written to VRAM 34 to the data line drive circuit 101 and scan line drive circuit 102 of the display unit 4.

Next, the drawing chip 30 sets the voltage of the VEP pin to 15 V and goes to the main drive state; the 0 V voltage of the VCOM pin is applied to the common electrode 137; the 0 V voltage of the S1 pin is applied to the pixel electrodes 135 of the white pixels that do not change and remain white; and the 15 V of the S2 pin is applied to the pixel electrodes 135 of the pixels that change to black. As a result, the potential difference between the common electrode 137 and the pixel electrodes 135 of the pixels that remain white is 0 V, the potential difference between the common electrode 137 and the pixel electrodes 135 of the pixels that change to black becomes +15 V, and the pixels that desirably become black are changed to black by the partial pixel drive method.

The drawing chip 30 then sets the voltage of the VCOM pin to 15 V while the S1 pin voltage is held at 0 V and the S2 pin voltage at 15 V, and enters the adjustment drive state. In this adjustment drive state, the potential difference between the common electrode 137 and the pixel electrodes 135 of the white pixels is −15 V, the potential difference between the common electrode 137 and the pixel electrodes 135 of the black pixels is 0 V, and the contrast that is degraded by the effect of the voltage applied in the main drive state is adjusted by the partial pixel drive method.

Next, the drawing chip 30 sets the voltage of the VCOM pin, S1 pin, and S2 pin to 0 V, goes to the discharge state, the charge accumulated between the pixel electrodes 135 and the common electrode 137 is cleared, and the field between the pixel electrodes 135 and the common electrode 137 goes to 0.

Finally, the drawing chip 30 sets the VEP pin, VCOM pin, S1 pin, and S2 pin to the Hi-Z state, sets the enable pin XPDW to 0 V, and ends the process of drawing a new screen image.

Because the image updating method in this embodiment of the invention displays the next image after first setting all pixels to display white, the problem of the tone changing between images is largely avoided. In addition, because average time of the field applied between the pixel electrodes 135 and the common electrode 137 is substantially 0 and a DC balance is maintained in the image updating method of this embodiment, the long term reliability of the electrophoretic display device 7 can be assured.

However, the drive time (the on time of the drive pulse) required to erase an image or draw a new image on the display unit 4 (EPD panel) varies according to the temperature, and the required drive time generally increases as the temperature decreases. This embodiment of the invention therefore changes the drive time according to the temperature when updating the displayed image.

A data table showing the correlation between temperature and the on time of the drive pulse is therefore stored in flash ROM 12 in the processor chip 10. FIG. 9 shows an example of a data table showing the correlation between temperature and the on time of the drive pulse for drawing a new image. The relationship between temperature range and the main drive time, the adjustment drive time, and the discharge time is shown in the data table shown in FIG. 9. The main drive time, the adjustment drive time, and the discharge time are, respectively, the duration of the main drive state of the waveforms shown in FIG. 8, the duration of the adjustment drive state, and the duration of the discharge state. Note that the totals of the main drive time, the adjustment drive time, and the discharge time are also shown for convenience in the data table in FIG. 9, but this total time information may be omitted. In general, because the main drive time and the discharge time increase as the temperature decreases, $A_1>=A_2>=A_3>=A_4>=A_5>=A_6$ and $C_1>=C_2>=C_3>=C_4>=C_5>=C_6$. Because the adjustment drive time is determined according to the state of the black particles 126 and white particles 127 after the main drive state, there is generally no regularity to the relative length of $B_1$, $B_2$, $B_3$, $B_4$, $B_5$, $B_6$. Because the main drive time and the discharge time largely determine the total time, the total time generally increases as the temperature decreases, and $D_1>=D_2>=D_3>=D_1>=D_5>=D_6$.

Note that while not shown in the figures, a data table describing the correlation between the temperature and the drive pulse on time required to erase an image (information about the drive time of the waveforms shown in FIG. 7) is similarly stored in the flash ROM 12.

The processor chip 10 gets the temperature measurement from the thermometer chip 40 before updating the image, references the data table stored in flash ROM 12, and, for example, specifies the on time of the drive pulse appropriate to the temperature when instructing the drawing chip 30 to transfer the image data to the display unit 4.

Image Updating Process of the Processor Chip

Figure 10:
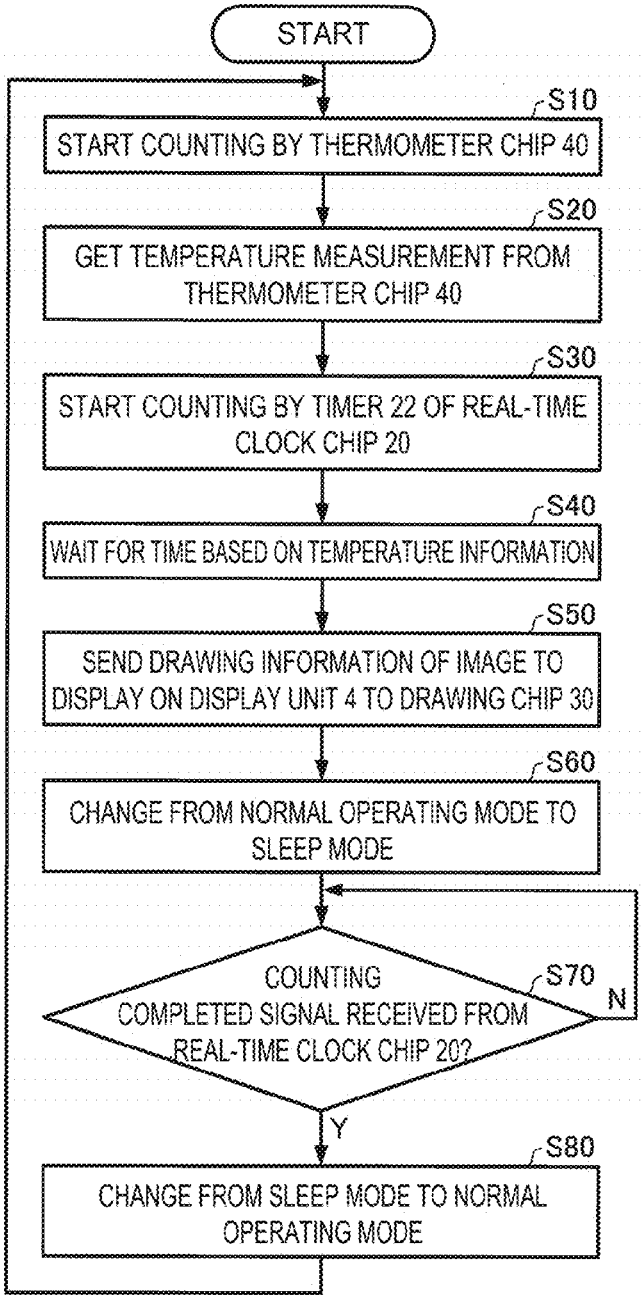
FIG. 10 is a flowchart of steps in the image updating process of the processor chip in a first embodiment of the invention.

FIG. 10 is a flow chart illustrating steps in the image updating process of the processor chip 10.

As shown in FIG. 10, in the normal operating mode, the processor chip 10 first starts temperature measurement by the thermometer chip 40 (S10).

Next, the processor chip 10 gets the temperature information (temperature measurement) from the thermometer chip 40 after the thermometer chip 40 has determined the temperature (S20).

Next, the processor chip 10 starts counting by the timer 22 of the real-time clock chip 20 (S30). As a result, the real-time clock chip 20 starts counting a specific time or the time set by the processor chip 10.

Next, the processor chip 10 waits for the time determined by the temperature information acquired from the thermometer chip 40 in step S20 (S40). This delay time assures the image is updated at the optimum timing for the temperature.

Next, the processor chip 10 sends the drawing information (macro command) for the image to be displayed on the display unit 4 to the drawing chip 30 (S50). The drawing chip 30 displays the image on the display unit 4 based on this drawing information (macro command).

Next, the processor chip 10 goes from the normal operating mode to the sleep mode (S60), and waits to receive a counting completed signal (interrupt signal) from the real-time clock chip 20 (S70: N).

When the timer 22 stops counting, the real-time clock chip 20 sends the counting completed signal (interrupt signal) to the processor chip 10. When the processor chip 10 receives this counting completed signal (interrupt signal) (S70: Y), it goes from the sleep mode to the normal operating mode (S80), and then repeats the process from step S10.

Timing Chart for the Minute Update Mode

Figure 11:
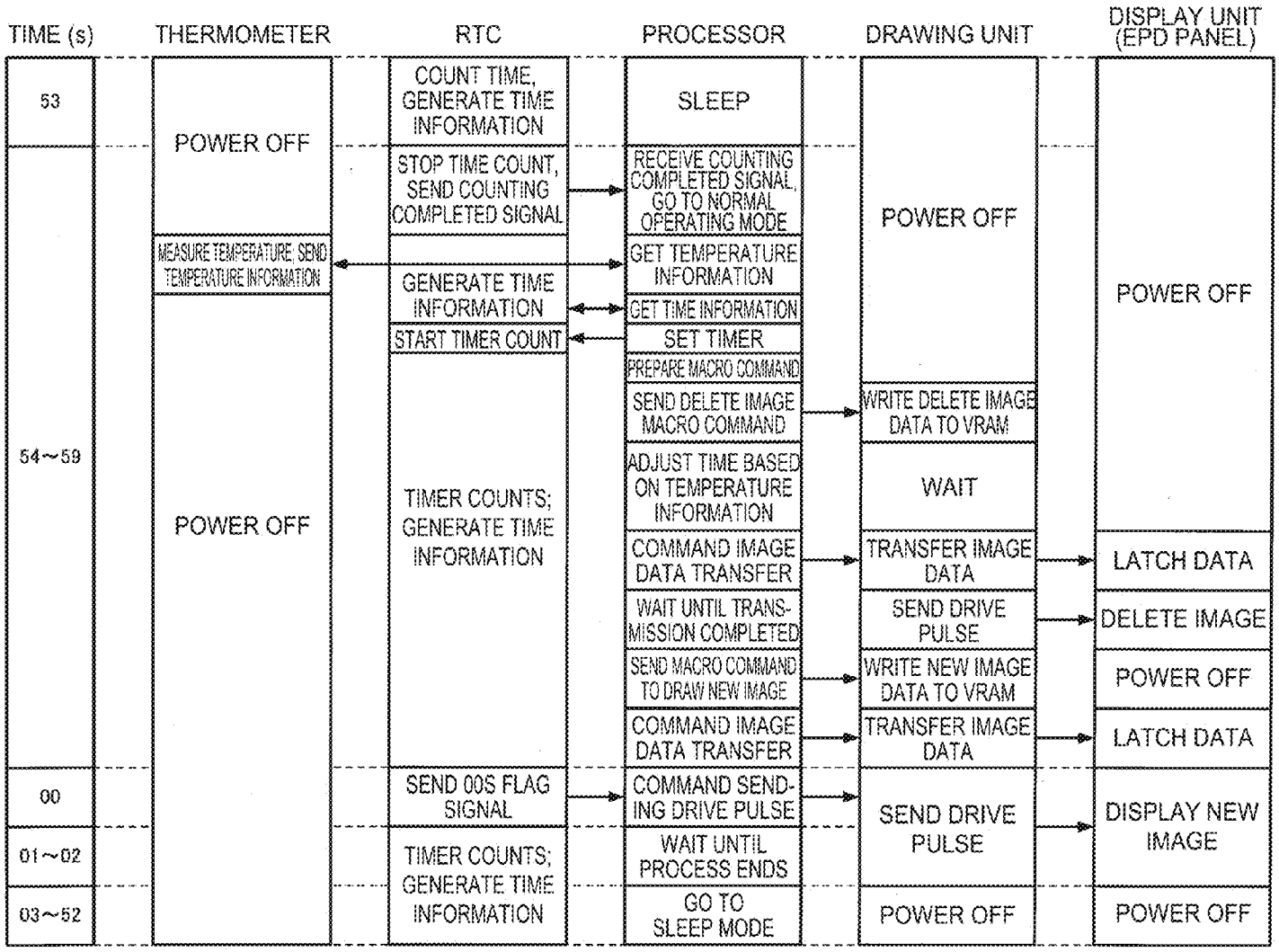
FIG. 11 is a timing chart of the process in the minute updating mode in the first embodiment of the invention.

A timing chart of the minute update mode for updating the displayed time on a one-minute cycle (an example of a specific cycle) is shown in FIG. 11 as an example of image updating by the electronic timepiece 1 (or the electrophoretic display device 7) according to this embodiment of the invention. The content of the processes executed by the thermometer chip 40, the real-time clock chip 20, the processor chip 10, the drawing chip 30, and the display unit 4 at each second of every minute is shown in FIG. 11.

In the example in FIG. 11, at second 53 of every minute, the thermometer chip 40 power is off, the processor chip 10 is sleeping (in the sleep mode), the power to the drawing chip 30 and the display unit 4 is off, and the real-time clock chip 20 is running the counting and time information generating process of the timer 22.

At second 54 of every minute, the real-time clock chip 20 stops counting by the timer 22, and sends the counting completed signal (interrupt signal) to the processor chip 10. The processor chip 10 receives the counting completed signal (interrupt signal) and goes to the normal operating mode.

In the following interval to second 59, the processor chip 10 first turns the power of the thermometer chip 40 on, starts temperature measurement, and gets the temperature information (temperature measurement) from the thermometer chip 40. The processor chip 10 then turns the thermometer chip 40 power off after getting the temperature information.

The processor chip 10 next communicates with the real-time clock chip 20 and gets the time information.

Next, the processor chip 10 sets the timer 22 (issues a start counting command and sets the time count), and the real-time clock chip 20 starts counting by the timer 22.

Based on the acquired time information, the processor chip 10 then determines the image to be newly displayed on the display unit 4, and prepares the macro commands required to display the next image (delete image macro command and draw new image macro command).

The processor chip 10 then turns the drawing chip 30 power on, and sends the delete image macro command to the drawing chip 30. Based on this macro command, the drawing chip 30 writes image data for erasing the currently displayed image to VRAM 34.

The processor chip 10 then adjusts the time based on the acquired temperature information, and commands the drawing chip 30 to transfer the image data.

The drawing chip 30 receives this command, turns the display unit 4 power on, transfers the image data written to the VRAM 34 to the display unit 4, and sends a drive pulse to the display unit 4. The display unit 4 receives and latches the image data, receives the drive pulse, and erases the current image.

The processor chip 10 then sends the draw new image macro command to the drawing chip 30. Based on this macro command, the drawing chip 30 writes the new image data to VRAM 34.

Next, the processor chip 10 commands the drawing chip 30 to transfer the image data. The drawing chip 30 receives this command, and transfers the image data from VRAM 34 to the display unit 4. The display unit 4 receives and latches the image data.

At precisely the 00 second of every minute, the real-time clock chip 20 sends a 00 second flag signal to the processor chip 10. The processor chip 10 receives this flag signal, and commands the drawing chip 30 to send a drive pulse.

The drawing chip 30 receives this command and sends the drive pulse to the display unit 4, and the display unit 4 receives the drive pulse and displays the new image between second 00 and second 02.

The processor chip 10 then turns the drawing chip 30 power off at second 03, and enters the sleep mode. The drawing chip 30 turning off also turns the display unit 4 power off.

Between second 03 and second 53, the thermometer chip 40 power is off, the processor chip 10 is sleeping, and the drawing chip 30 and display unit 4 are also in a power off state. The real-time clock chip 20 is continuously on to run the time information generating process.

The processor chip 10 thus operates in the normal operating mode for only the 9 seconds from second 54 of every minute to second 03 of the next minute, is in the sleep mode for the other 51 seconds, and can therefore suppress an increase in power consumption.

As described above, because in the electronic timepiece 1 or electrophoretic display device 7 according to the first embodiment of the invention the processor chip 10 starts counting by the timer 22 of the real-time clock chip 20 and sends drawing information for the image to be displayed on the display unit 4 to the drawing chip 30 in the normal operating mode, then goes to the sleep mode, and returns to the normal operating mode after receiving the counting completed signal (interrupt signal) in the sleep mode, operation of the processor chip 10 stops when not updating the image on the display unit 4, and increased power consumption can be suppressed. An electronic timepiece that can operate for several years using a small capacity battery such as a button battery, for example, can therefore be provided.

Furthermore, because the electronic timepiece 1 or the electrophoretic display device 7 according to the first embodiment of the invention has a highly versatile processor chip 10 with in-built flash ROM 12, program code containing all programs required by multiple models, and macro command sets containing all macro commands required by the multiple models, can be prepared, the programs and macro commands required for individual models can be selectively written to the flash ROM 12, and different models of electronic timepieces 1 can be manufactured in a few steps. The number of steps in program development is also reduced.

2. Embodiment 2

Because the drive time of the display unit 4 (EPD panel) changes according to the temperature in the electronic timepiece 1 according to the first embodiment of the invention, the processor chip 10 adjusts the timing of the image update according to the temperature, and an adjustment time (delay time) therefor is thus required. To match the timing of the image update in this configuration, the adjustment time (delay time) increases as the temperature increases (as the drive time gets shorter), and the processor chip 10 therefore wastes power.

This second embodiment of the invention reduces wasted power by changing the sleep time of the processor chip 10 according to the temperature information.

The electronic timepiece 1 according to the second embodiment of the invention is identical to the electronic timepiece 1 according to the first embodiment of the invention except for the process executed by the processor chip 10, like parts in this and the electronic timepiece 1 according to the first embodiment of the invention are therefore identified by like reference numerals, and description common to both is omitted below where primarily the differences with the first embodiment are described.

Image Updating Process of the Processor Chip

Figure 12:
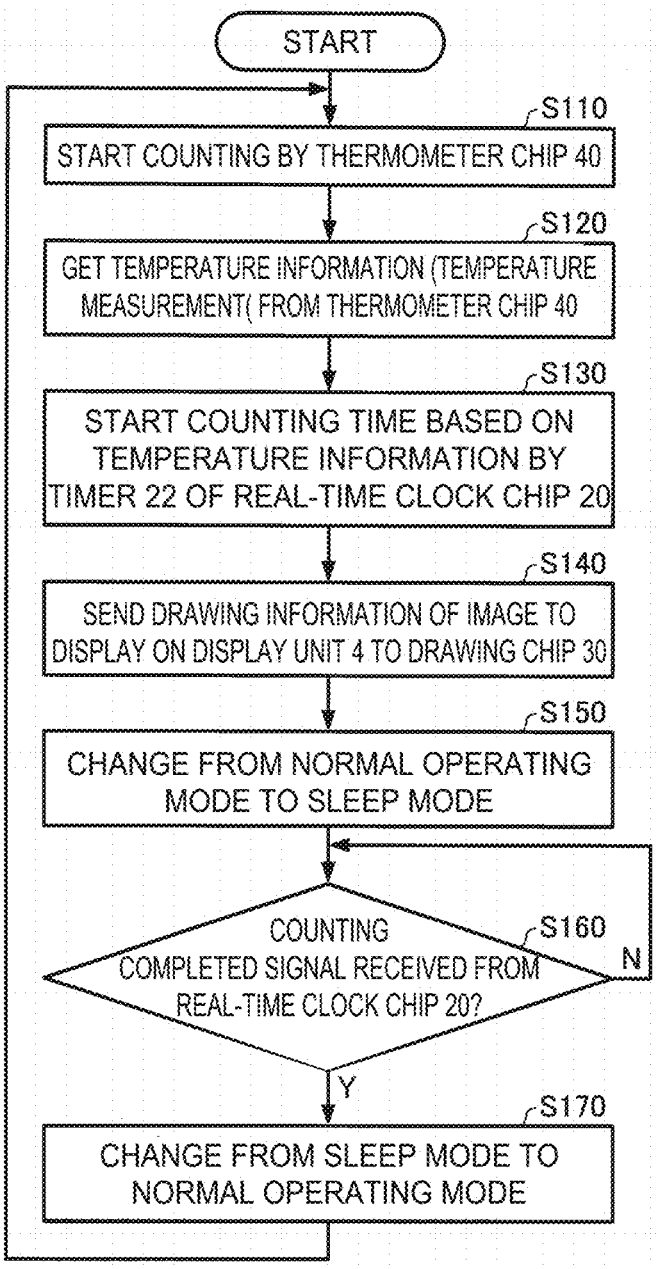
FIG. 12 is a flowchart of steps in the image updating process of the processor chip in a second embodiment of the invention.

FIG. 12 is a flow chart illustrating steps in the image updating process of the processor chip 10 in a electronic timepiece 1 according to the second embodiment of the invention.

As shown in FIG. 12, in the normal operating mode, the processor chip 10 first starts temperature measurement by the thermometer chip 40 (S110).

Next, the processor chip 10 gets the temperature information (temperature measurement) from the thermometer chip 40 after the thermometer chip 40 has determined the temperature (S120).

Next, the processor chip 10 starts counting a time corresponding to the temperature information by the timer 22 of the real-time clock chip 20 (S130). As a result, the real-time clock chip 20 starts counting a time that differs according to the temperature as specified by the processor chip 10. By setting this time, the operating time of the processor chip 10 in the normal operating mode is optimized for the temperature.

Next, the processor chip 10 sends the drawing information (macro command) for the image to be displayed on the display unit 4 to the drawing chip 30 (S140). The drawing chip 30 displays the image on the display unit 4 based on this drawing information (macro command).

Next, the processor chip 10 goes from the normal operating mode to the sleep mode (S150), and waits to receive a counting completed signal (interrupt signal) from the real-time clock chip 20 (S160: N).

When the timer 22 stops counting, the real-time clock chip 20 sends the counting completed signal (interrupt signal) to the processor chip 10. When the processor chip 10 receives this counting completed signal (interrupt signal) (S160: Y), it goes from the sleep mode to the normal operating mode (S170), and then repeats the process from step S110.

Timing Chart for the Minute Update Mode

Figure 13:
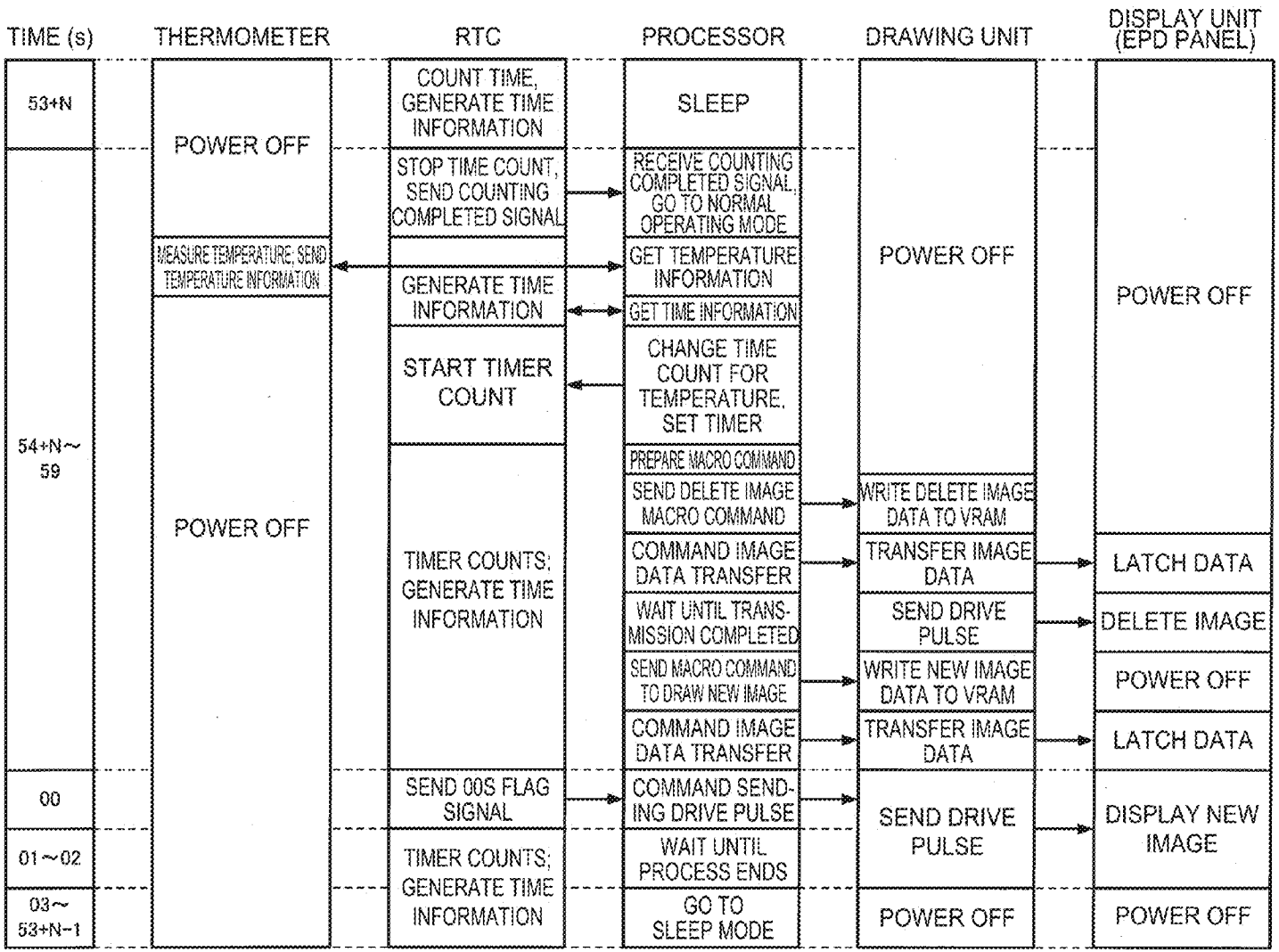
FIG. 13 is a timing chart of the process in the minute updating mode in the second embodiment of the invention.
Figure 14:
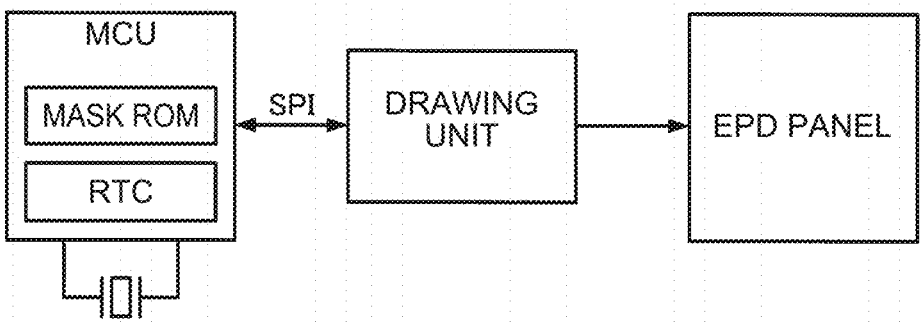
FIG. 14 is a function block diagram of an EPD watch according to the related art.

A timing chart of the minute update mode for updating the displayed time on a one-minute period (an example of a specific period) is shown in FIG. 13 as an example of image updating by the electronic timepiece 1 (or the electrophoretic display device 7) according to the second embodiment of the invention. Note that content that is the same in the timing chart in FIG. 13 and the timing chart in FIG. 11 is omitted.

Unlike in the timing chart in FIG. 11, in the timing chart in FIG. 13 the time when the processor chip 10 goes from the sleep mode to the normal operating mode is not limited to second 54 of every minute, and varies to second (54+N) according to the temperature.

In order to change the time for going to the normal operating mode according to the temperature, the processor chip 10 changes the time counted by the timer 22 according to the temperature information acquired from the thermometer chip 40 while operating in the normal operating mode, and sets the timer 22 accordingly. More specifically, because the on time of the drive pulse becomes shorter as the temperature get higher, the processor chip 10 increases the time counted by the timer 22 as the temperature increases. The real-time clock chip 20 then starts counting by the timer 22 (starts counting the variably set time).

Also unlike in the timing chart in FIG. 11, in the timing chart in FIG. 13 the processor chip 10 does not execute a step of adjusting the time based on the temperature information. Therefore, the length of time the processor chip 10 operates in the normal operating mode changes with the temperature, and the operating time of the processor chip 10 gets shorter as the temperature increases. More specifically, while the operating time of the processor chip 10 is a fixed 9 seconds every minute in the timing chart shown in FIG. 11, the operating time of the processor chip 10 changes every minute to (9−N) seconds according to the temperature in the timing chart shown in FIG. 13.

If N=0 at the lowest possible operating temperature of the electronic timepiece 1 in the flow chart in FIG. 13, the operating time of the processor chip 10 is adjusted to a minimum required time of 9 seconds or less, and the amount of power consumed needlessly by the processor chip 10 can be reduced.

In addition to achieving the same effect as the electronic timepiece 1 or electrophoretic display device 7 according to the first embodiment, the electronic timepiece 1 or electrophoretic display device 7 according to the second embodiment of the invention as described above also further reduces wasteful power consumption by optimizing the sleep time of the processor chip 10 according to the temperature information.

The present invention is not limited to the embodiments described above, and can be varied in many ways without departing from the scope of the accompanying claims.

For example, the foregoing embodiments describe a wristwatch having an electrophoretic display device, but the invention is not limited to wristwatches, and can be applied, for example, to mantle clocks and mobile electronic timepieces, electronic devices having other timekeeping and clock functions, wrist-worn sports devices such as runner's watches, and wearable devices including pulse monitors.

The foregoing embodiments and variations are only examples, and the invention is not limited thereto. For example, the foregoing embodiments and variations can be combined in many ways.

The invention includes configurations that are effectively identical to the embodiments described above (including configurations having the same function, method, and effect, or configurations having the same objective and effect). The invention also includes configurations substituting non-essential parts of the configuration described in the foregoing embodiments. The invention also includes configurations having the same operational effect as the configurations described in the foregoing embodiments, and configurations that can achieve the same objective. The invention further includes configurations that add technology known from the literature to the configurations described in the foregoing embodiments.

What is claimed is:

1. An electrophoretic display device comprising:

a display including two substrates and an electrophoretic element containing electrophoretic particles disposed between the two substrates;

a processor having a first mode and a second mode of lower power consumption than the first mode;

a time information generator that generates time information; and a drawing chip that displays an image on the display and that has a power-on state and a power-off state;

wherein the time information generator includes a timer that counts time, and sends a counting completed signal to the processor when the timer counts a specific time period;

when the counting completed signal is received, the processor, in sequence, transitions from the second mode to the first mode, sends drawing information of the image to the drawing chip, restarts counting by the timer, and transitions from the first mode to the second mode; and the drawing chip transitions to the power-on state to drive a first potential difference between the two substrates, and transitions to the power-off state wherein it does not drive the two substrates, wherein the first mode of the processor is executed while the drawing chip is in the power-on state and the power off state, and the second mode of the processor is executed while the drawing chip is not in the power-on state but in the power-off state.

2. The electrophoretic display device described in claim 1, wherein:

the drawing chip displays an image on the display on a specific cycle; and one period in the specific cycle includes a period in which the processor is in the second mode.

3. The electrophoretic display device described in claim 2, wherein:

the specific cycle is a cycle for displaying an image containing time information;

the processor sends drawing information for the image to display on the display to the drawing chip in the first mode; and the drawing chip displays the image containing time information on the display based on the drawing information.

4. The electrophoretic display device described in claim 1, wherein:

in the first mode, the processor receives a flag signal indicating the draw timing from the time information generator, and controls the timing when the drawing chip displays the image on the display based on the received flag signal.

5. The electrophoretic display device described in claim 1, further comprising:

a temperature sensor;

wherein in the first mode, the processor gets temperature information from the temperature sensor, and controls the timing for sending drawing information for the image to display on the display to the drawing chip based on the acquired temperature information.

6. The electrophoretic display device described in claim 1, further comprising:

a temperature sensor;

wherein in the first mode, the processor gets temperature information from the temperature sensor, and controls the length of the specific time based on the acquired temperature information.

7. The electrophoretic display device described in claim 1, wherein:

the processor includes a rewritable memory storing program information and command information for the drawing chip, wherein the processor:

reads and executes the program information from the memory, reads the command information from the memory, and sends drawing information of the image to display on the display to the drawing chip.

8. The electrophoretic display device described in claim 1, wherein:

the processor, the time information generator, and the drawing chip operate on supply voltage supplied from a primary battery.

9. An electronic timepiece comprising the electrophoretic display device described in claim 1.

10. A wristwatch comprising the electrophoretic display device described in claim 1.

11. The electrophoretic display device described in claim 1, wherein:

the processor includes an internal oscillator circuit and is synchronized to a clock signal output from the internal oscillator circuit in the first mode, the internal oscillator circuit being stopped in the second mode.

12. An operating method of an electrophoretic display device, the operating method comprising:

counting time by a timer which is included in a time information generator of the electrophoretic display device, the time information generator generating time information;

sending a counting completed signal from the time information generator to a processor of the electrophoretic display device when the timer counts a specific time period;

switching the processor from a second mode to a first mode after the processor receives the counting completed signal from the time information generator, the processor consuming less power in the second mode than in the first mode;

sending a first signal from the processor to a drawing chip of the electrophoretic display device to set the drawing chip in a power-on state in which a display drives a first potential difference between two substrates;

sending a second signal from the processor to the drawing chip to set the drawing chip in a power-off state in which the drawing chip does not drive the two substrates; and switching the processor from the first mode to the second mode, wherein:

the first mode of the processor is executed while the drawing chip is in the power-on state and in the power-off state, and the second mode of the processor is executed while the drawing chip is not in the power-on state but in the power-off state.

13. The operating method of an electrophoretic display device described in claim 12, wherein:

the processor includes an internal oscillator circuit and is synchronized to a clock signal output from the internal oscillator circuit in the first mode, the internal oscillator circuit being stopped in the second mode.

* * * * *